United States Patent [19]

Kobayashi et al.

[11] Patent Number: 4,719,888

[45] Date of Patent: Jan. 19, 1988

[54] METHOD AND APPARATUS FOR CONTROLLING AIR-FUEL RATIO IN INTERNAL COMBUSTION ENGINE

[75] Inventors: Nobuyuki Kobayashi; Takashi Hattori; Toshimitsu Ito, all of Toyota, Japan

[73] Assignee: Toyota Jidosha Kabushiki Kaisha, Toyota, Japan

[21] Appl. No.: 731,524

[22] Filed: May 7, 1985

[30] Foreign Application Priority Data

May 7, 1984 [JP] Japan ..... 59-89240

[51] Int. Cl.[4] ..... F02B 3/00

[52] U.S. Cl. ..... 123/440; 123/492; 123/494

[58] Field of Search ..... 123/492, 440, 489, 494

[56] References Cited

U.S. PATENT DOCUMENTS 4,385,608 5/1983 Ohgami ..... 123/440

4,480,606 11/1984 Kato ..... 123/489

*Primary Examiner*—Ronald B. Cox

*Attorney, Agent, or Firm*—Cushman, Darby & Cushman

[57] ABSTRACT

In an internal combustion engine, when the opening of a throttle valve is smaller than a relatively small definite value, the feedback of the air-fuel ratio of the engine is controlled so that the air-fuel ratio is brought close to a first target air-fuel ratio. When the opening of the throttle valve is equal to or larger than a relatively small definite value and is smaller than a relatively large definite value, the feedback of the air-fuel ratio of the engine is controlled so that the air-fuel ratio is brought close to a second target air-fuel ratio on the rich side with respect to the first target air-fuel ratio. Further, when the opening of the throttle valve is equal to or larger than the relatively large definite value, the air-fuel ratio of the engine is controlled to be a power fuel increment air-fuel ratio.

4 Claims, 8 Drawing Figures

FAF ROUTINE
1001
ARE F/B CONDITIONS SATISFIED ?
NO
YES
1002
LNSR ≦ IR ?
NO
YES
1003
CAFL ← "1"
1004
CAFR = "1" ?
NO
YES
1005
FAF ← FAF-SKP1
1007
FAF ← FAF-K1
1006
CAFR ← "0"
1014
STORE FAF IN RAM
RETURN
1015

KLEAN ROUTINE

1201
F 2 = "1" ?
YES
NO
1202
KLEANPM
1.0
PM
1203
KLEANNE
1.0
Ne
1208
KLEAN ← KLEANPM · KLEANNE
1204
KLEAN ← 1.0
1205
F 1 = "1" ?
NO
YES
1206
KLEAN<X ?
NO
YES
KLEAN←X
1207
STORE KLEAN IN RAM
1209
RETURN
1210

METHOD AND APPARATUS FOR CONTROLLING AIR-FUEL RATIO IN INTERNAL COMBUSTION ENGINE

BACKGROUND OF THE INVENTION (1) Field of the Invention

The present invention relates to a method and apparatus for feedback control of the air-fuel ratio in an internal combustion engrne.

(2) Description of the Related Art

As a measure taken against exhaust gas pollution and fuel consumption, a lean burn system has recently been developed. According to this lean burn system, a lean mixture sensor is provided for generating an analog current in proportion to the air-fuel mixture on the lean side in an exhaust pipe of an engine. Thus, the feedback of the air-fuel ratio of the engine can be controlled by using the analog output of the lean mixture sensor, thereby attaining an arbitrary air-fuel ratio on the lean side.

In such a lean burn system, when the throttle valve opening is smaller than a definite value, such as 50°, feedback control of the air-fuel ratio of the engine is carried out so that the air-fuel ratio is brought close to a target air-fuel ratio calculated in accordance with a predetermined parameter, such as the intake air pressure PM or the intake air amount Q. Note that such a target air-fuel ratio is also called a base air-fuel ratio. On the other hand, when the throttle valve opening is equal to or larger than the definite value, feedback control of the air-fuel ratio is stopped. Instead of this, power fuel increment control is carried out to obtain a power output air-fuel ratio of the engine.

That is, as illustrated in FIG. 1, when driving at a low altitude location, when the throttle valve opening TA becomes 50°, the base air-fuel ratio A/F is already considerably small, i.e., on the rich side as indicated by an arrow $X_1$ in FIG. 1. Therefore, even when the air-fuel feedback control is changed to power fuel increment control or vice versa, the change $\Delta A/F$ of the base air-fuel ratio A/F is relatively small. Therefore, the torque T changes relatively smoothly.

Note that the relationship of the torque T to the base air-fuel ratio A/F is illustrated in FIG. 3, and power fuel increment control is usually carried out at a base air-fuel ratio A/F of about 12 to 13.

However, when driving at a high altitude location, as illustrated in FIG. 2, even when the throttle valve opening TA becomes 50°, the base air-fuel ratio A/F is still at a high level, i.e., on the lean side, as indicated by an arrow $X_2$. Therefore, when air-fuel ratio feedback control is changed to power fuel increment control or vice versa, the change $\Delta A/F$ of the base air-fuel ratio A/F is relatively large. Therefore, the torque T rapidly changes, thus reducing drivability.

SUMMARY OF THE INVENTION

It is an object of the present invention to provide a method and apparatus for controlling the air-fuel ratio in an internal combustion engine which can avoid rapid torque change when driving at a high altitude location.

Another object is to reduce the torque fluctuation in the driving mode at a low altitude location even when rapid torque change in a driving mode for a high altitude location is avoided.

According to the present invention, in an internal combustion engine, when the opening of a throttle valve is smaller than a relatively small definite value, the feedback of the air-fuel ratio of the engine is controlled so that the air-fuel ratio is brought close to a first base air-fuel ratio. When the opening of the throttle valve is equal to or larger than the relatively small definite value and is smaller than a relatively large definite value, feedback of the air-fuel ratio of the engine is controlled so that the controlled air-fuel ratio is brought close to a second base air-fuel ratio on the rich side with respect to the first base air-fuel ratio. Further, when the opening of the throttle valve is equal to or larger than the relatively large definite value, the air-fuel ratio of the engine is controlled to be a power fuel increment air-fuel ratio.

That is, if the relatively large definite value and the relatively small definite value are, for example, 50° and 25°, respectively, the base air-fuel ratio A/F in a driving mode for a high altitude location changes as illustrated in FIG. 4, i.e., the base air-fuel ratio A/F changes by two steps, so that the change of the base air-fuel ratio A/F becomes small, as compared with the prior art as illustrated in FIG. 2 in which the base air-fuel ratio A/F changes by a single step, thus reducing the change of torque.

However, in driving at a low altitude location, if the base air-fuel ratio A/F changes by two steps, it falls to the lean side as indicated by an arrow $X_3$ in FIG. 5, thus inviting fluctuation of torque. For reducing such fluctuation of torque, the allowed limit value on the lean side is applied to the second base air-fuel ratio. That is, the second target air-fuel ratio is equal to or smaller than the allowed limit value.

BRIEF DESCRIPTION OF THE DRAWINGS

The present invention will be more clearly understood from the description as set forth below with reference to the accompanying drawings, wherein.

DESCRIPTION OF THE PREFERRED EMBODIMENT

Figure 1:
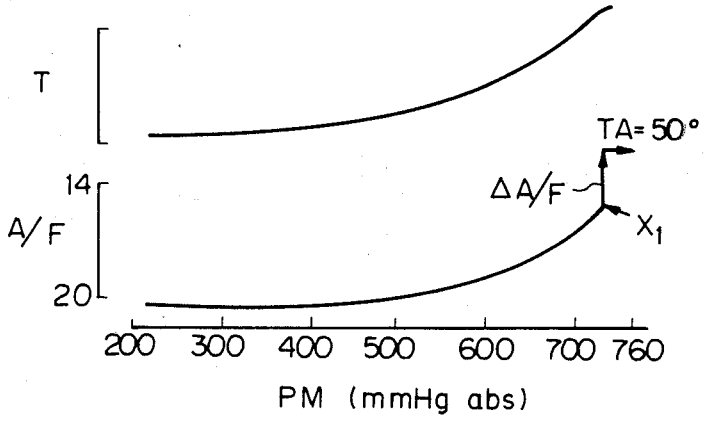
Fig. 1 PRIOR ART
FIGS. 1 and 2 are graphs showing the characteristics of the torque and the base air-fuel ratio in the prior art.
Figure 2:
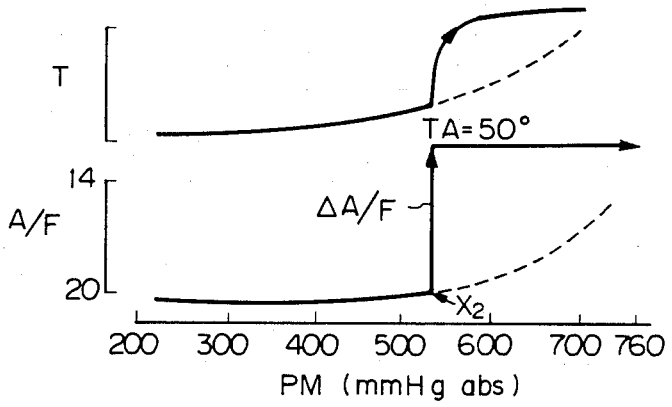
Fig. 2 PRIOR ART
Figure 3:
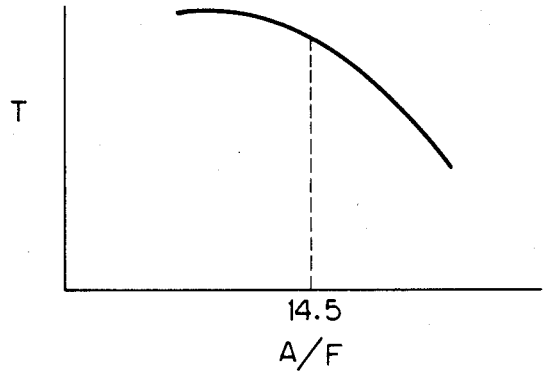
FIG. 3 is a graph showing the relationship of the torque to the base air-fuel ratio.
Figure 4:
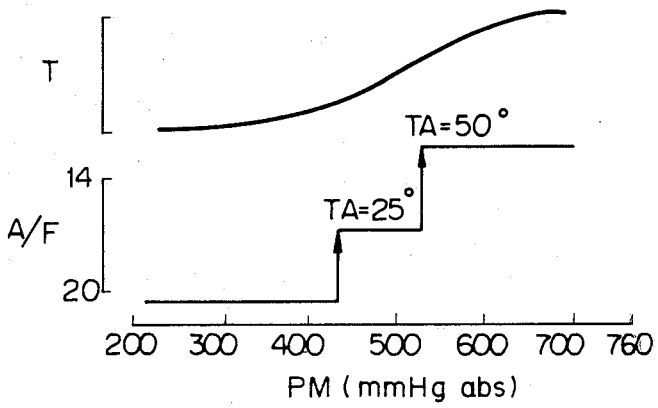
FIGS. 4 and 5 are graphs showing the characteristics of the torque and the base air-fuel ratio according to the present invention.

In FIG. 1, which illustrates an internal combustion engine according to the present invention, reference numeral 1 designates a four-cycle spark ignition engine disposed in an automotive vehicle. Provided in an air-intake passage 2 of the engine 1 is a surge tank 3 in which a pressure sensor 4 is provided. The pressure sensor 4 is used for detecting the absolute pressure within the intake-air passage 2 and transmits its output signal to a multiplexer-incorporating analog-to-digital (A/D) converter 101 of a control circuit 10.

Provided in a throttle valve 5 of the intake air passage 2 is a throttle sensor 6 which incorporates two switches. One of the switches is turned on when the opening TA of the throttle valve 5 is larger than a relatively small definite value such as 25°, while the other is turned on when the opening TA of the throttle valve 5 is larger than a relatively large definite value such as 50°. The outputs of the throttle sensor 6 are supplied to an input-/output (I/O) interface 103 of the control circuit 10.

Disposed in a distributor 7 are crank angle sensors 8 and 9 for detecting the angle of the crankshaft (not shown) of the engine 1. In this case, the crank-angle sensor 8 generates a pulse signal at every 720° crank angle (CA) while the crank-angle sensor 9 generates a pulse signal at every 30° CA. The pulse signals of the crank angle sensors 8 and 9 are supplied to the I/O interface 103 of the control circuit 10. In addition, the pulse signal of the crank-angle sensor 9 is then supplied to an interruption terminal of a central processing unit (CPU) 105.

Figure 6:
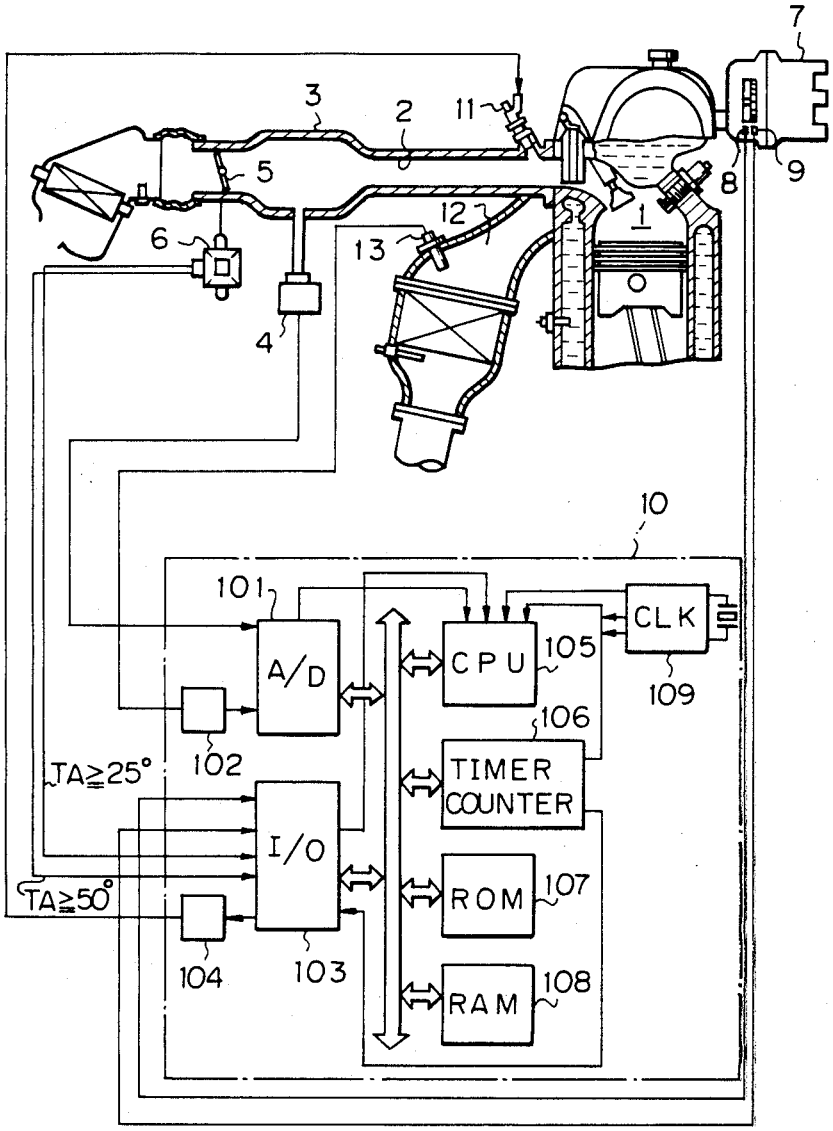
FIG. 6 is a schematic diagram of an internal combustion engine according to the present invention.

Additionally provided in the air-intake passage 2 is a fuel injector 11 for supplying pressurized fuel from the fuel system (not shown) to the air-intake port of the cylinder of the engine 1. In this case, other fuel injectors are also provided for other cylinders, though not shown in FIG. 6.

Figure 7:
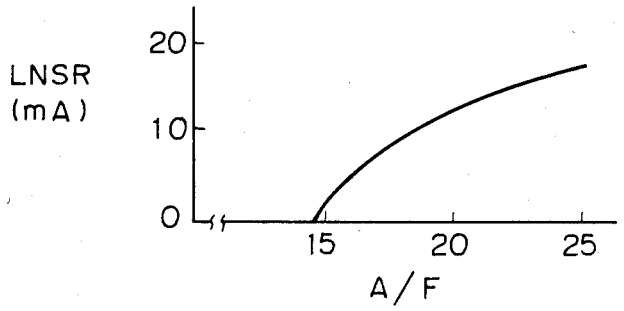
FIG. 7 is a graph showing the output characteristics of the lean mixture sensor of FIG. 6.

Provided in an exhaust gas passage 12 of the engine 1 is a lean mixture sensor 13 for detecting the concentration of oxygen composition in the exhaust gas. The lean mixture sensor 13 generates a limit current signal LNSR as shown in FIG. 7 and transmits it via a current-to-voltage converter circuit 102 of the control circuit 10 to the A/D converter 101 thereof.

The control circuit 10, which may be comprise by a microcomputer, includes a driver circuit 104 for driving the fuel injector 11, a timer counter 106, a read-only memory (ROM) 107 for storing a main routine, interrupt routines such as a fuel injection routine, an ignition timing routine, tables (maps), constants, etc., a random access memory 108 (RAM) for storing temporary data, a clock generator 109 for generating various clock signals, and the like, in addition to the A/D converter 101, the current-to-voltage converter circuit 102, the I/O interface 103, and the CPU 105.

The timer counter 106 may include a free-run counter, a compare register, a comparator for comparing the content of the free-run counter with that of the compare register, flag registers for compare interruption, injection control, and the like. Of course, the timer counter 106 also may include a plurality of compare registers and a plurality of comparators. In this case, the timer counter 106 is used for controlling the injection start and end operation.

Interruptions occur at the CPU 105, when the A/D converter 101 completes an A/D conversion and generates an interrupt signal; when the crank-angle sensor 9 generates a pulse signal; when the timer counter 106 generates a compare interrupt signal; and when the clock generator 109 generates a special clock signal.

The pressure data PM of the pressure sensor 4 and the limit current data LNSR of the lean mixture sensor 13 are fetched by an A/D conversion routine executed at every predetermined time period and are then stored in the RAM 108. That is, the data PM and LNSR in the RAM 108 are renewed at every predetermined time period. The engine rotational speed Ne is calculated by an interrupt routine executed at 30° CA, i.e. at every pulse signal of the crank angle sensor 9, and is then stored in the RAM 108.

Figure 8A:
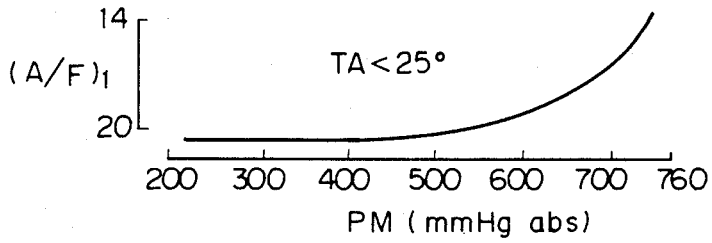
FIG. 8A, 8B, and 8C are graphs showing the characteristics of the base air-fuel ratio used in the present invention.
Figure 8B:
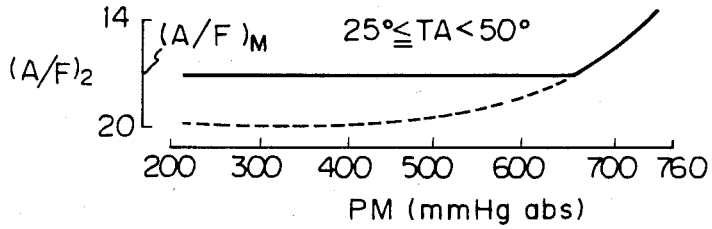
Figure 8C:
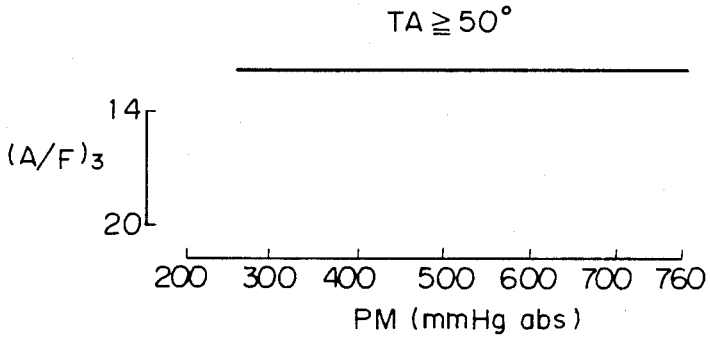

FIGS. 8A, 8B, and 8C are graphs of the base air-fuel ratio used in the present invention. When the opening TA of the throttle valve 5 is smaller than 25°, feedback of the air-fuel ratio of the engine is carried out so that the air-fuel ratio is brought close to a base air-fuel ratio $(A/F)_1$ calculated in accordance with the intake air pressure data PM as shown in FIG. 8A. However, in FIG. 8A, it is actually impossible to realize PM=760 mmHg abs when TA<25°. Also, when the opening TA of the throttle valve 5 is equal to or larger than 25° and is smaller than 50°, feedback of the air-fuel ratio of the engine is carried out so that the air-fuel ratio is brought close to a base air-fuel ratio $(A/F)_2$ calculated in accordance with the intake air pressure data PM as shown in FIG. 8B. In this case, the base air-fuel ratio $(A/F)_2$ is on the rich side as compared with the base air-fuel ratio $(A/F)_1$. Also, it is preferable to apply a limit $(A/F)_M$ on the lean side to the base air-fuel ratio $(A/F)_2$, in order to reduce the torque fluctuation in driving at a low altitude location. That is, $(A/F)_2 \leqq (A/F)_M$. Further, when the opening TA of the throttle valve 5 is equal to or larger than 50°, feedback control of the air-fuel ratio of the engine is stopped, and a power fuel increment corresponding to the base air-fuel ratio $(A/F)_3$(=about 12 to 13) as shown in FIG. 8C is calculated.

Figure 9:
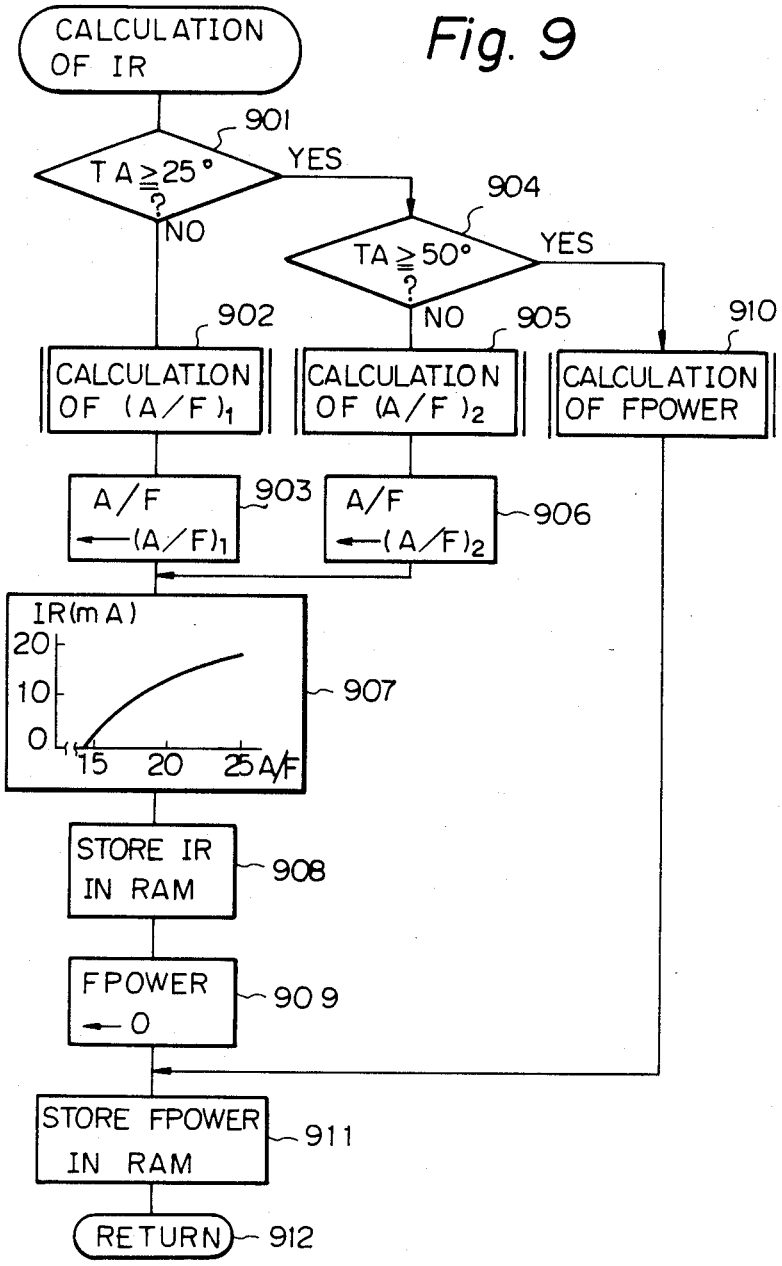
FIGS. 9 through 16 are flow charts showing the operation of the control circuit of FIG. 6.

FIG. 9 is a routine for calculating a base air-fuel ratio executed as one part of the main routine, or at a predetermined time period or crank angle.

At step 901, one of the outputs of the throttle sensor 6 is fetched from the I/O interface 103, and it is determined whether or not the opening TA of the throttle valve 5 satisfies TA≧25°. At step 902 the other of the outputs of the throttle sensor 6 is fetched from the I/O interface 103, and it is determined whether or not the opening TA of the throttle valve 5 satisfies TA≧50°.

As a result, if TA<25°, the control proceeds to step 902, in which a base air-fuel ratio $(A/F)_1$ is calculated from a one-dimensional map stored in the ROM 107 by using the parameter PM as shown in FIG. 8A. Then, at step 903, $A/F \leftarrow (A/F)_1$. If 25≦TA<50°, then the control proceeds to step 905 in which a base air-fuel ratio $(A/F)_2$ is calculated from a one-dimensional map stored in the ROM 107 by using the parameter PM as shown in FIG. 8B. Then, at step 906, $A/F \leftarrow (A/F)_2$. Further, at step 907, a comparison reference value IR of the limit current LNSR of the lean sensor 13 is calculated from a one-dimensional map by using the parameter A/F, and then at step 908, IR is stored in the RAM 108. Further, at step 910, a power fuel increment FPOWER is cleared.

On the other hand, if TA≧50°, the control proceeds to step 910, in which a power fuel increment FPOWER is calculated from a two-dimensional map stored in the ROM 107 by using the parameters PM and Ne.

Then, at step 911, FPOWER obtained at step 909 or 910 is stored in the RAM 108. This routine is completed by step 912.

Figures 10, 10A, 10B:
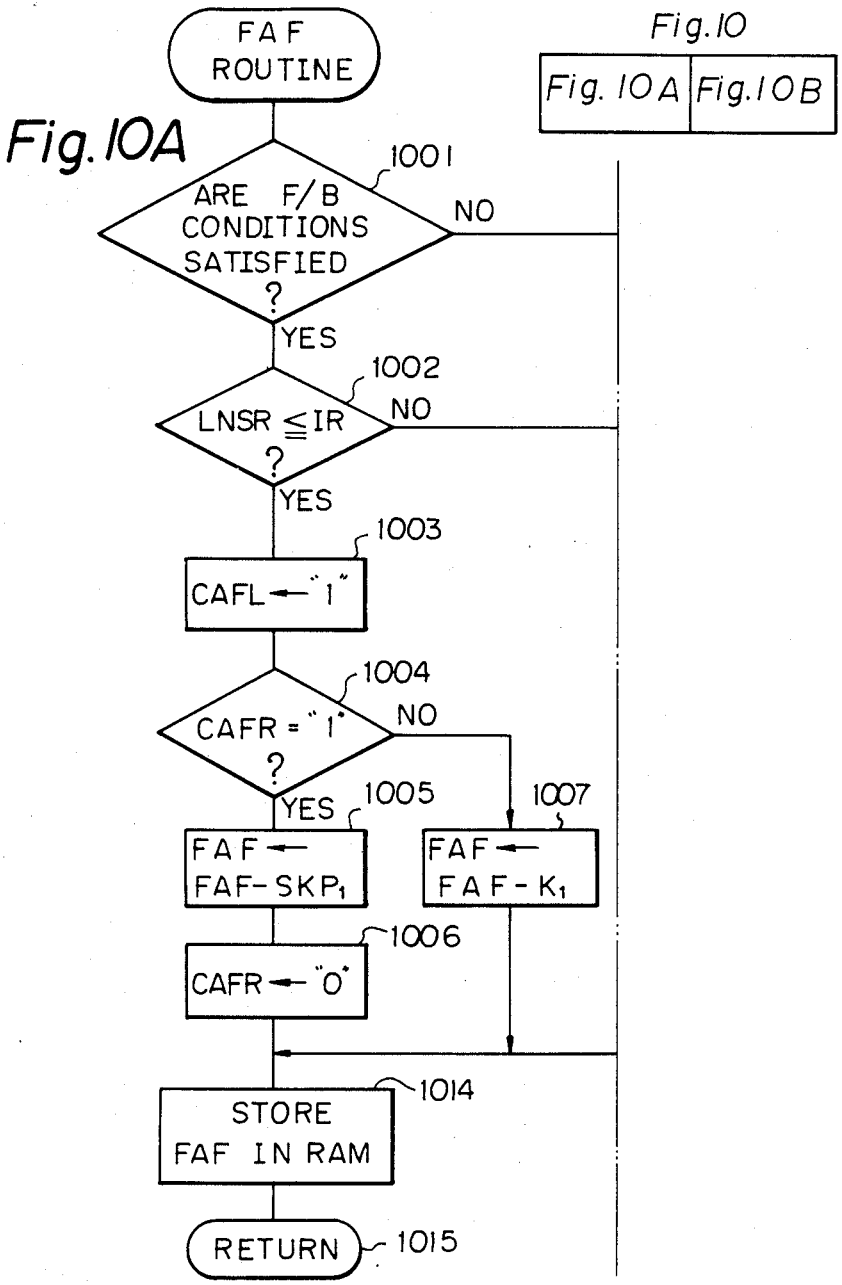
Figure 10B:
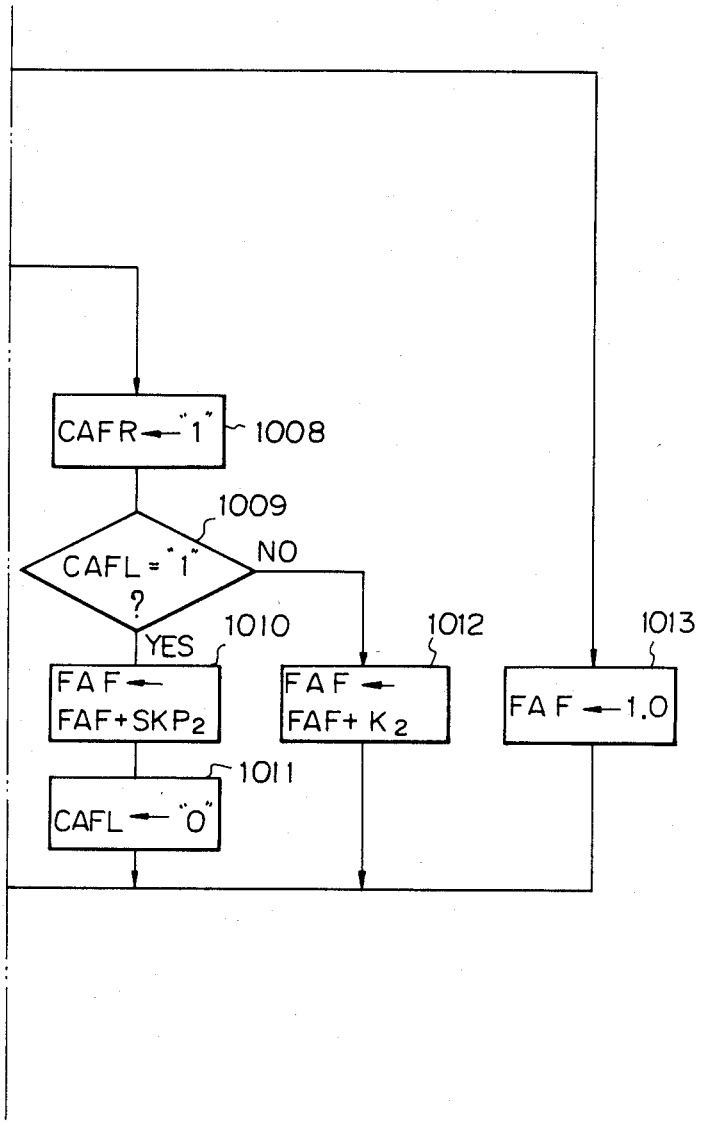

FIG. 10 is a routine for calculating an air-fuel ratio feedback correction coefficient FAF executed at every predetermined time period.

At step 1001, it is determined whether or not all the feedback control (closed-loop control) conditions are satisfied. The feedback control conditions are as follows:

(i) the engine is not in a starting state;

(ii) the coolant temperature THW is higher than a definite value; and (iii) the power fuel increment FPOWER is 0.

Of course, other feedback control conditions are introduced as occasion demands. However, an explanation of such other feedback control conditions is omitted.

If one or more of the feedback control conditions is not satisfied, the control proceeds to step 1013, in which the coefficient FAF is set to 1.0 (FAF =1.0), thereby carrying out an open-loop control operation. Contrary to this, if all the feedback control conditions are satisfied, the control proceeds to step 1002.

At step 1002, the output LNSR of the lean mixture sensor 13 stored in the RAM 108 is compared with the comparison reference value IR, thereby determining whether the current air-fuel ratio is on the rich side or on the lean side with respect to the target air-fuel ratio. If LNSR<IR so that the current air-fuel ratio is on the rich side, the control proceeds to step 1003, in which a lean skip flag CAFL is set, i.e., CAFL←"1". Note that the lean skip flag CAFL is used for a skip operation when a first change from the rich side to the lean side occurs in the controlled air-fuel ratio.

At step 1004, it is determined whether or not a rich skip flag CAFR is "1". Note that the skip flag CAFR is used for a skip operation when a first change from the lean side to the rich side occurs in the controlled air-fuel ratio. As a result, if the rich skip flag CAFR is "1", the control proceeds to step 1005, which decreases the coefficient FAF by a relatively large amount $SKP_1$. Then, at step 1006, the rich skip flag CAFR is cleared, i.e., CAFR←"0". Thus, when the control at step 1004 is further carried out, then the control proceeds to step 1007, which decreases the coefficient FAF by a relatively small amount $K_1$. Here, $SKP_1$ is a constant for a skip operation which remarkably decreases the coefficient FAF when a first change from the lean side (LNSR>IR) to the rich side (LNSR≦IR) occurs in the controlled air-fuel ratio, while $K_1$ is a constant for an integration operation which gradually decreases the coefficient FAF when the controlled air-fuel ratio is on the rich side.

On the other hand, at step 1002, if LNSR>IR so that the current air-fuel ratio is on the lean side, the control proceeds to step 1008 in which the rich skip flag CAFR is set, i.e., CAFR←"1". Then, at step 1009, it is determined whether or not the lean skip flag CAFL is "1". As a result, if the lean skip flag CAFL is "1", the control proceeds to step 1010, which increases the coefficient FAF by a relatively large amount $SKP_2$. Then, at step 1011, the lean skip flag CAFL is cleared, i.e., CAFL←"0". Thus, when the control at step 1009 is further carried out, then the control proceeds to step 1012, which increases the coefficient FAF by a relatively small amount $K_2$. Here, $SKP_2$ is a constant for a skip operation which remarkably increases the coefficient FAF when a first change from the rich side (LNSR≦IR) to the lean side (LNSR>IR) occurs in the controlled air-fuel ratio, while $K_2$ is a constant for an integration operation which gradually increases the coefficient FAF when the controlled air-fuel ratio is on the lean side.

The air-fuel feedback correction coefficient FAF obtained at steps 1005, 1007, 1010, 1012, or 1013 is stored in the RAM 108, and the routine of FIG. 10 is completed by step 1015.

Figure 11:
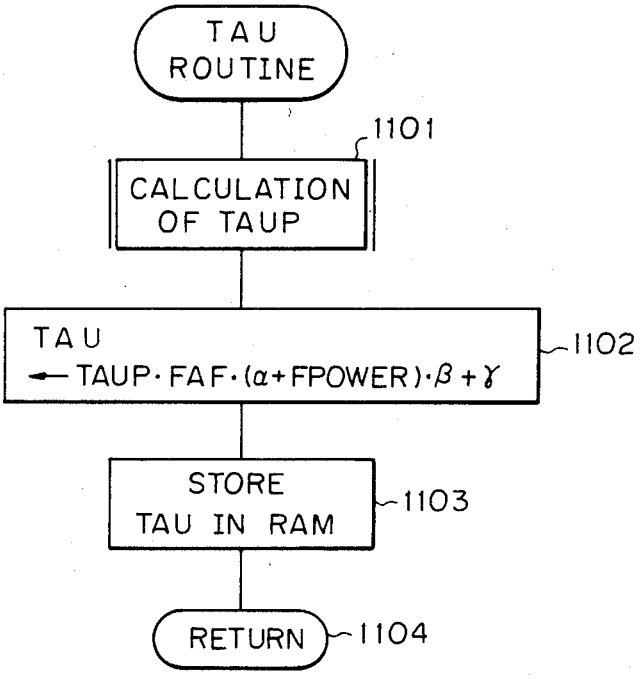

FIG. 11 is a routine for calculating a fuel injection time period TAU executed at every predetermined crank angle. For example, this routine is executed at every 360° CA in a simultaneous fuel injection system for simultaneously injecting all the injectors and is executed at every 180° CA in a sequential fuel injection system applied to a four-cylinder engine for sequentially injecting the injectors thereof.

At step 1101, a base fuel injection time period TAUP is calculated from a two-dimensional map stored in the ROM 107 by using the parameters PM and Ne. Then, at step 1102, a fuel injection time period TAU is calculated by $$TAU \leftarrow TAUP \cdot FAF \cdot (\alpha + FPOWER) \cdot \beta + \gamma$$

where $\alpha$, $\beta$, and $\gamma$ are correction factors determined by other parameters such as the signal of the intake air temperature sensor, the voltage of the battery (both not shown), and the like. At step 1103, the calculated fuel injection time period TAU is stored on the RAM 108, and the routine of FIG. 11 is completed by step 1104.

Figure 13:
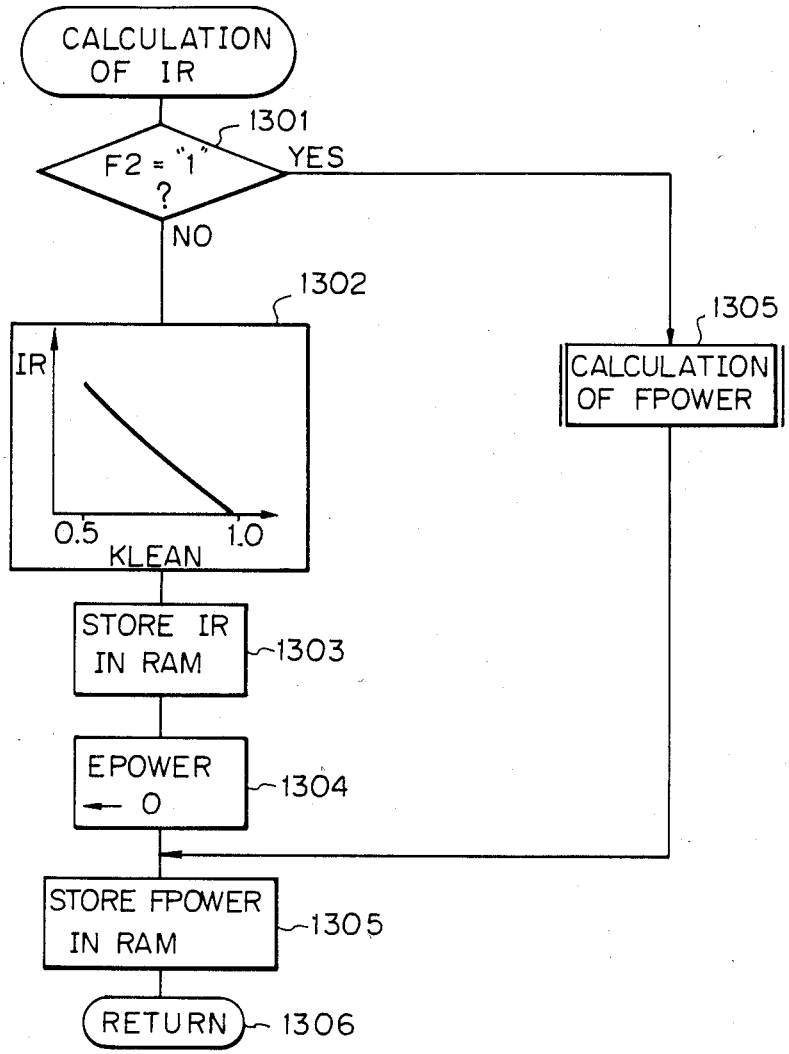
Figure 14:
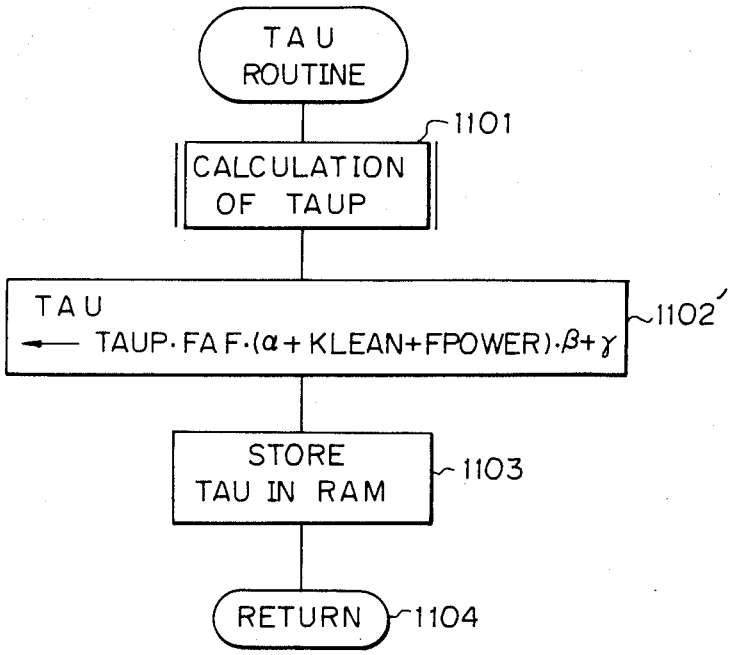

Another example of controlling fuel injection amount will be explained with reference to FIGS. 12, 13, and 14. Note FIGS. 12 and 13 are provided instead of FIG. 9, and FIG. 14 is provided instead of FIG. 11.

Figure 12:
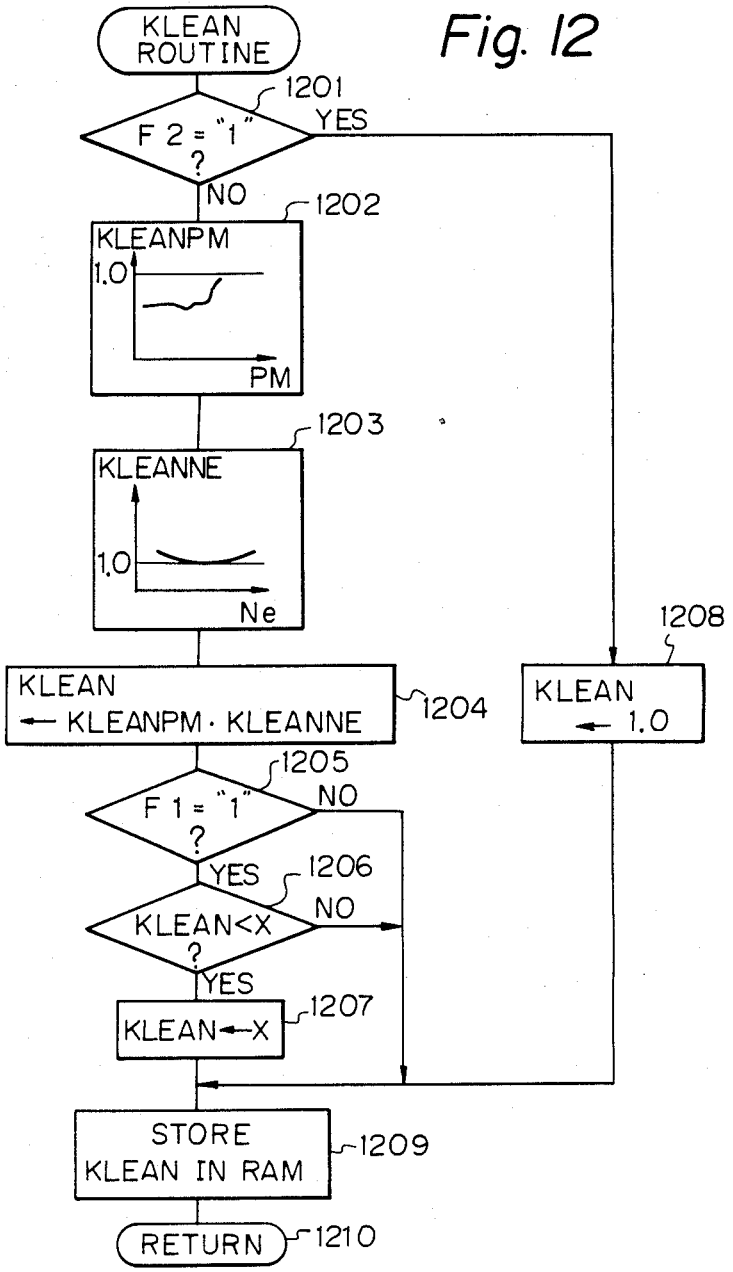

FIG. 12 is a routine for calculating a lean air-fuel ratio correction coefficient KLEAN executed at every predetermined time period. Note that the coefficient KLEAN satisfies the condition: KLEAN≦1.0.

At step 1201, it is determined whether or not the flag F2 is "1". If F2="1", then the control proceeds to step 1208 which causes KLEAN to be 1.0. Contrary to this, if F2="0", the control proceeds to step 1202.

At step 1202, KLEANPM is calculated from a one-dimensional map stored in the ROM 107 by using the parameter PM as shown in the block of step 1202. Also, at step 1203, KLEANNE is calculated from a one-dimensional map stored in the ROM 107 by using the parameter Ne as shown on the block of step 1203. Then at step 1204, $$KLEAN \leftarrow KLEANPM \cdot KLEANNE.$$

Figure 5:
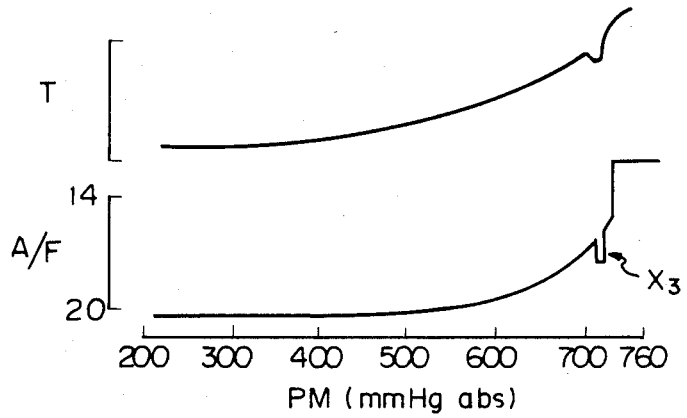

At step 1205, it is determined whether or not the flag F1 is "1". If F1="1", then the control proceeds to steps 1206 and 1207, which guard the value KLEAN by a minimum value X. That is, at step 1206, it is determined whether or not KLEAN<X is satisfied. Only if satisfied, the control proceeds to step 1207, which replaces KLEAN with X. Note that such a minimum value X corresponds to the horizontal line of FIG. 5B.

Then at step 1209, KLEAN is stored in the RAM 108, and this routine of FIG. 12 is completed by step 1210.

FIG. 13 is a routine for clculating a comparison reference value IR executed at every predetermined time period.

At step 1301, it is determined whether or not the flag F2 is "1". If F2="1", the control proceeds to step 1305 which calculates a fuel increment FPOWER from a two-demensional map using the parameters PM and Ne. If F2="0", then the control proceeds to step 1302 in which a comparison reference value IR is calculated from a one-demensional map stored in the ROM 107 by using the parameter KLEAN as shown in the block of step 1302, and then at step 1303, IR is stored in the RAM 108. Further, at step 1304, a power fuel increment FPOWER is cleared.

Then, at step 1305, FPOWER obtained at step 1304 or 1305 is stored in the RAM 108. This routine is completed by step 1306.

In FIG. 14, step 1102' is provided instead of step 1102 of FIG. 11. At step 1102', a fuel injection time period TAU is calculated by $$TAU \leftarrow TAUP \cdot FAF \cdot (\alpha + KLEAN + FPOWER) \cdot \beta + \gamma.$$

Figure 15:
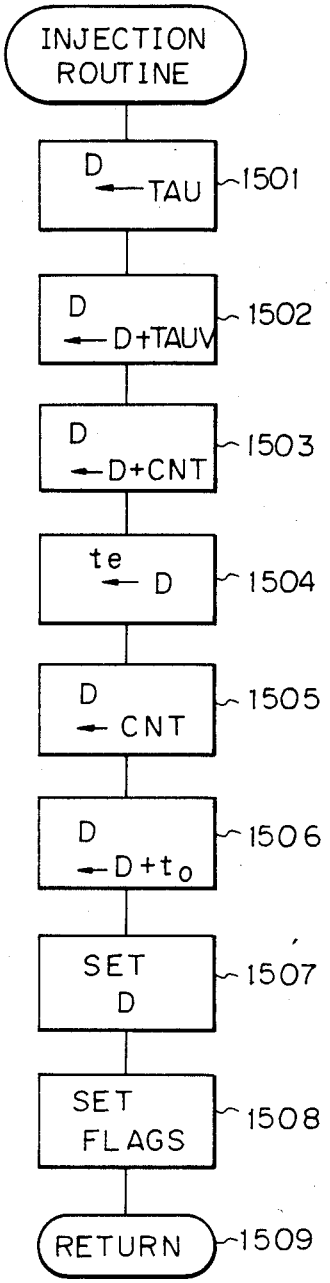

FIG. 15 is a routine for controlling the fuel injection in accordance with the fuel injection time period TAU calculated by the routine of FIG. 11 or 14, executed at every predetermined crank angle. Also, this routine is executed at every 360° CA in a simultaneous fuel injection system and is executed at every 180° CA in an sequential fuel injection system applied to a four-cylinder engine.

At step 1501, the fuel injection time period TAU stored in the RAM 108 is read out and is transmitted to the D register (not shown) included in the CPU 105. At step 1502, an invalid fuel injection time period TAUV which is also stored in the RAM 108 is added to the content of the D register. In addition, at step 1503, the current time CNT of the free-run counter of the timer counter 106 is read out and is added to the content of the D register, thereby obtaining an injection end time $t_e$ in the D register. Therefore, at step 1504, the content of the D register is stored as the injection end time $t_e$ in the RAM 108.

Again at step 1505, the current time CNT of the free-run counter is read out and is set in the D register. Then, at step 1506, a small time period $t_0$, which is definite or determined by the predetermined parameters, is added to the content of the D register. At step 1507, the content of the D register is set in the compare register of the timer counter 106, and at step 1508, a fuel injection execution flag and a compare interrupt permission flag are set in the registers of the timer counter 106. The routine of FIG. 15 is completed by step 1509.

Figure 16:
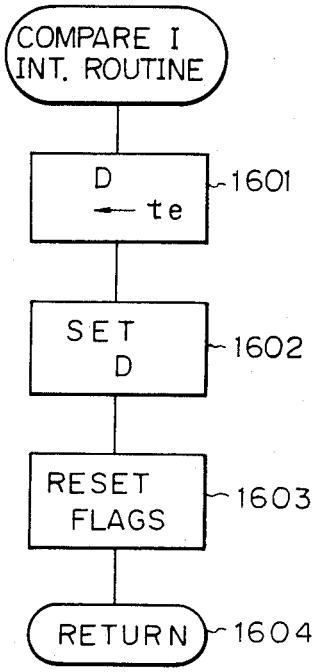

Thus, when the current time CNT of the free-run counter reaches the compare register, an injection-on signal due to the presence of the fuel injection execution flag is transmitted from the time counter 6 via the I/O interface 103 to the driver circuit 104, thereby initiating fuel injection by the fuel injector 11. Simultaneously, a compare interrupt signal due to the presence of the compare interrupt permission flag is transmitted from the timer counter 106 to the CPU 105, thereby initiating a compare interrupt routine as illustrated in FIG. 16.

The completion of the fuel injection will be explained with reference to FIG. 16. At step 1601, the injection end time $t_e$ stored in the RAM 108 is read out and is transmitted to the D register. Then, at step 1602, the content of the D register, i.e., the injection end time $t_e$, is set in the compare register of the timer counter, and at step 1603, the fuel injection execution flag and the compare interrupt permission flag are reset. The routine of FIG. 16 is completed by step 1604.

Thus, when the current time CNT of the free-run counter reaches the compare register, an injection-off signal due to the absence of the fuel injection execution flag is transmitted from the timer counter 106 via the I/O interface 103 to the driver circuit 104, thereby ending the fuel injection by the fuel injection 11. In this case, however, no compare interrupt signal is generated due to the absence of the compare interrupt permission flag.

Thus, fuel injection of the fuel injector 11 is carried out for the time period TAU.

Note that the present invention can be also applied to a fuel injection system using the other parameters such as the intake air amount and the engine speed or the throttle opening value and the engine speed.

As explained above, according to the present invention, rapid torque changes in driving at a high altitude location can be avoided. In addition, the torque fluctuation in driving at a low altitude location can be reduced.

We claim:

1. A method for controllng the air-fuel ratio in an internal combustion engine having a throttle valve therein, comprising the steps of:

detecting an intake air pressure of said engine;

detecting an opening of said throttle valve;

controlling the air-fuel ratio of said engine so that said air-fuel ratio is close to a power fuel increment air-fuel ratio by which a torque output of said engine is at a maximum when the opening of said throttle valve is larger than a first predetermined value;

calculating a first target air-fuel ratio which changes continuously in accordance with the detected intake air pressure and which is leaner than said power fuel increment air-fuel ratio, when the opening of said throttle valve is between said first predetermined value and a second predetermined value smaller than first predetermined value;

loading a second target air-fuel ratio independent of the detected intake air pressure, when the opening of said throttle valve is between said first and second predetermined values, said second target air-fuel ratio being such that performance of said engine is not degraded even when the controlled air-fuel ratio is changed rapidly from said second target air-fuel ratio to said power fuel increment air-fuel ratio, thereby rapidly changing the output torque of said engine, said second target air-fuel ratio being leaner than said power-fuel increment air-fuel ratio;

controlling a feedback of the air-fuel ratio of said engine so that the air-fuel ratio approaches a richer air-fuel ratio between said first and second target air-fuel ratios, when the opening of said throttle valve is betweeen said first and second predetermined values; and controlling the feedback of said air-fuel ratio of said engine so that said air-fuel ratio approaches said first target air-fuel ratio, when the opening of said throttle valve is smaller than said second predetermined value.

2. A method for controlling the air-fuel ratio in an internal combustion engine having a throttle valve therein, comprising the steps of:

detecting an intake air amount of said engine;

detecting an opening of said throttle valve;

controlling the air-fuel ratio of said engine so that said air-fuel ratio is closed to a power fuel increment air-fuel ratio by which a torque output of said engine is at a maximum when the opening of said throttle valve is larger than a first predetermined value;

calculating a firt target air-fuel ratio which changes continuously in accordance with the detected intake air amount and which is leaner than said power fuel increment air-fuel ratio, when the opening of said throttle valve is between said first predetermined value and a second predetermined value smaller than said first predetermined value;

loading a second target air-fuel ratio independent of the detected intake air amount, when the opening of said throttle valve is between said first and second predetermined values, said target air-fuel ratio being such that the performance of said engine is not degraded even when the controlled air-fuel ratio is changed rapidly from said second target air-fuel ratio to said power fuel increment air-fuel ratio, thereby rapidly changing the output torque of said engine, said second target air-fuel ratio being leaner than said power fuel increment air-fuel ratio;

controlling a feedback of the air-fuel ratio of said engine so that said air-fuel ratio approaches a richer air-fuel ratio between said first and second target air-fuel ratios, when the opening of said throttle valve is between said first and second predetermined values; and controlling the feedback of the air-fuel ratio of said engine so that said air-fuel ratio approaches said first target air-fuel ratio, when the opening of said throttle valve is smaller than said second predetermined value.

3. Apparatus for controlling the air-fuel ratio in an internal combustion engine having a throttle valve therein, comprising the step of:

means for detecting an intake air-pressure of said engine;

means for detecting an opening of said throttle valve; and processing means for (a) controlling the air-fuel ratio of said engine so that said air-fuel ratio is closed to a power fuel increment air-fuel ratio by which a torque output of said engine is at a maximum when the opening of said throttle valve is larger than a first predetermined value, (b) calculating a first target air-fuel ratio which changes continuously in accordance with the detected intake air pressure and which is leaner than said power fuel increment air-fuel ratio, when the opening of said throttle valve is between said first predetermined value and a second predetemined value smaller than said first predetermined value, (c) loading a second target air-fuel ratio independent of the detected intake air pressure, when the opening of said throttle valve is between said first and second predetermined values, said second target air-fuel ratio being such that performance of said engine is not degraded even when the controlled air-fuel ratio is changed rapidly from second target air-fuel ratio to said power fuel increment air-fuel ratio, thereby rapidly changing the output torque of said engine, said second target air-fuel ratio being leaner than said power fuel increment air-fuel ratio, (d) controlling a feedback of the air-fuel ratio of said engine so that the air-fuel ratio approaches an air-fuel ratio between said first and second target air-fuel ratios, when the opening of said throttle valve is between said first and secod predetermined values, and (e) controlling the feedback of the air-fuel ratio of said engine so that said air-fuel ratio approaches said first target air-fuel ratio when the opening of said throttle valve is smaller than said second predetermined value.

4. Apparatus for controlling the air-fuel ratio in an internal combustion engine having a throttle valve therein, comprising the steps of:

means for detecting an intake air amount of said engine;

means for detecting an opening of said throttle valve; and processing mean for (a) controlling the air-fuel ratio of said engine so that said air-fuel ratio is closed to a power fuel increment air-fuel ratio by which a torque output of said engine is at a maximum when the opening of said throttle valve is larger than a first predetermined value, (b) calculating a first target air-fuel ratio which changes continuously in accordance with the detected intake air amount and which is leaner than said power fuel increment air-fuel ratio, when the opening of said throttle valve is between said first predetermined value and a second predetermined value smaller than said first predetermined value, (c) loading a second target air-fuel ratio independent of the detected intake air amount, when the opening of said throttle valve is between said first and second predetermined values, said second target air-fuel ratio being such that performance of said engine is not degraded even when the controlled air-fuel ratio is changed rapidly from said second target air-fuel ratio to said power fuel increment air-fuel ratio, thereby rapidly changing the output torque of said engine, said second target air-fuel ratio being leaner than said power fuel increment air-fuel ratio, (d) controlling a feedback of the air-fuel ratio of said engine so that the air-fuel ratio approaches a richer air-fuel ratio between said first and second target air-fuel ratios, when the opening of said throttle valve is between said first and second predetermined values, and (e) controlling the feedback of the air-fuel ratio of said engine so that air-fuel ratio approaches said first target air-fuel ratio, when the opening of said throttle valve is smaller than said second predetermined value.

* * * * *